United States Patent [19]

Latasiewicz

[11] 4,181,826

[45] Jan. 1, 1980

[54] DOME SWITCH ACTUATING APPARATUS

[75] Inventor: Leonard Latasiewicz, Hoffman Estates, Ill.

[73] Assignee: Motorola, Inc., Schaumburg, Ill.

[21] Appl. No.: 894,054

[22] Filed: Apr. 6, 1978

[51] Int. Cl.[2] ..... H01H 13/70; H01H 25/04; H01H 3/12

[52] U.S. Cl. ..... 200/340

[58] Field of Search ..... 200/5 R, 5 A, 16 A, 200/16 C, 16 D, 159 R, 159 A, 159 B, 264, 295, 290, 329, 340, 339, 86.5

[56] References Cited

U.S. PATENT DOCUMENTS

| | | | |
|---|---|---|---|
| 2,981,816 | 4/1961 | Cozart | 200/159 A |
| 3,899,648 | 8/1975 | Murata | 200/5 A X |
| 3,917,917 | 11/1975 | Murata | 200/5 R X |
| 3,928,741 | 12/1975 | Comer | 200/5 A X |
| 4,045,650 | 8/1977 | Nestor | 200/264 X |
| 4,052,580 | 10/1977 | Stanish | 200/295 X |

*Primary Examiner*—James R. Scott
*Attorney, Agent, or Firm*—James W. Gillman; Melvin A. Klein

[57] ABSTRACT

An improved switch actuating apparatus operating dome switches in which a dome shaped switching member mounted on a circuit board is actuated by the action of an elongated button member urged in a linear direction or a pivotal direction into contact with the dome switching member against the action of a elastomeric member positioned between the elongated button member and dome switching member. The elastomeric member has an aperture formed therein through which a tip portion of the button member extends for contact with the dome switching member. The button member has a plurality of vertically extending leg members which are received through openings in the circuit board. The leg members each have a hook portion extending from the end thereof to effect the desired operation of the switching member through either a pushing or rocking action by an operator.

3 Claims, 3 Drawing Figures

DOME SWITCH ACTUATING APPARATUS

BACKGROUND OF THE INVENTION

This invention relates to dome switch actuating apparatus and, in particular, to the mounting and operation of dome switch push buttons operative to make and break an electrical circuit. Pushbuttons of the type with which the invention is concerned have wide usage in microphone devices in radios and the like.

Pushbuttons for actuating dome switches are normally assembled in a housing overlying a circuit board supporting the dome switches. A frame member called an "egg crate" positions the pushbuttons and orients them into operative relation to the switches as described, for example, in U.S. Pat. No. 3,879,586 or U.S. Pat. No. 3,917,917. It has been found that the use of such a frame member is not altogether satisfactory from the standpoint of assembly and ease of operation of the switches. A pushbutton construction not having an "egg crate" frame member is described in U.S. Pat. No. 3,928,741. However, this construction requires special washer construction and actuation from a positive linear force and thus restricts it application.

In accordance with the instant invention, pushbuttons are assembled in overlying relation to dome shaped switches positioned on circuit board without the use of the "egg crate". Furthermore, it is possible to align and captivate the actuating button in such a manner as to afford greater tolerances in the actuation of the dome switch. More specifically, a pivoting or rocking action in the sense of a "joystick" can be imparted to the pushbutton as well as the normal up and down or linear motion to open and close the dome switch.

SUMMARY OF THE INVENTION

It is therefore a general object of the present invention to improve pushbutton actuating devices for dome shaped switches.

It is a further object of the present invention to improve the alignment and captivation of actuating pushbuttons for dome shaped switches.

It is still a further object of the present invention to simplify the assembling and construction of pushbuttons by eliminating the need of an "egg crate" frame.

It is still a further object of the present invention to enable greater tolerances for operation of pushbuttons so that joystick operation is possible to actuate dome switches.

It is still a further object of the present invention to provide a simplified construction for pushbuttons operating dome switches.

BRIEF DESCRIPTION OF THE DRAWINGS

These objects as well as others will become more apparent after an understanding of the following description which we should be considered in conjunction with the accompanying drawings in which.

DETAILED DESCRIPTION OF THE INVENTION

Figure 1:
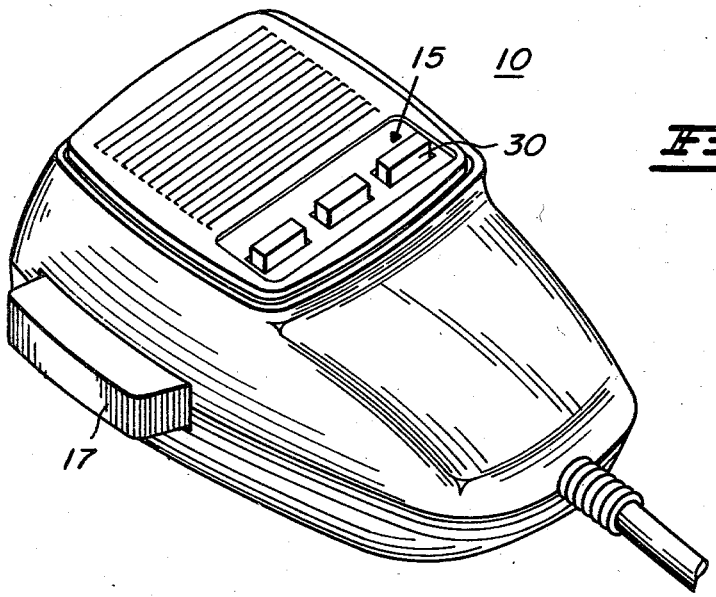
FIG. 1 is an isometric view of a microphone employing the pushbutton actuating apparatus according to the present invention.

In FIG. 1 there is shown a microphone assembly generally designated 10 having a plurality of pushbutton members 15 which are used to momentarily contact and thus close circuits associated with the microphone assembly operation. Typically a key member 17 is actuated to transmit voice signals through the microphone assembly.

Figure 2:
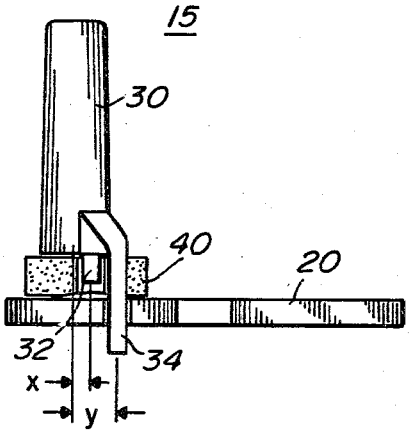
FIG. 2 is a side sectional view of a pushbutton apparatus of the invention.
Figure 3:
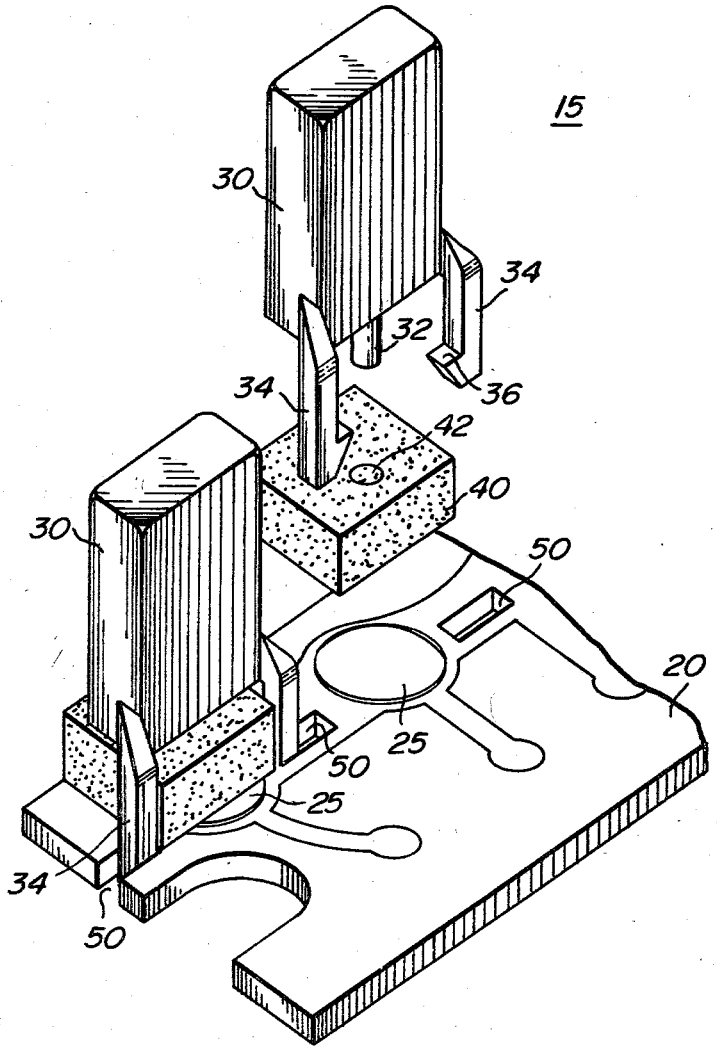
FIG. 3 is an exploded isometric view of the pushbutton apparatus illustrating certain details thereof.

As shown in FIGS. 2 and 3, each of the pushbutton members 15 is mounted on a circuit board member 20 in overlying relation to a dome switch 25. Switch 25 is actuated by momentary force with pushbutton member 15 in a manner to be described more fully hereinafter. It will be noted that pushbutton member 15 has an elongated body 30, a tip portion 32 and a plurality of vertically extending leg members 34. At the ends of leg members 34 are hook portions 36. It will be noted that tip portion 32 and leg members 34 are offset by a distance and Y, respectively (FIG. 2) from the longitudinal axis of the pushbutton body 30. By this structure stability in mounting and actuation is accomplished as will become more apparent hereinafter.

Circuit board 20 has openings 50 formed therein through which leg members 34 are received with hook portions 36. By this structure pushbutton members 15 are maintained in alignment and captivate over dome switch 25, through the cooperating action of leg members 34 and hook portions 36 and circuit board member 20.

In accordance with the invention positioned intermediate the pushbutton members and the dome switch 25 is an elastomeric member 40 which has an aperture 42 formed therein through which the tip portion 32 extends for a predetermined distance. It will be appreciated that by applying a downward force to the pushbutton member 15 that contact is made between tip portion 32 and switch member 25 against the biasing action afforded by elastomeric member 40. Upon release of the force on the pushbutton member contact between top portion 32 and switch member 25 is opened thereby breaking the circuit operation. By virtue of the offset X and Y of tip portion 32 and leg members 34 from the longitudinal axis of body 30, it is possible to actuate the dome switch 25 by a pivoting or rocking force. This is advantageous from the standpoint greatly facilitating operation of the dome switch and associated microphone circuit.

It will be appreciated that pushbutton member 15 can be made of either conductive or non-conductive material depending on circuit application. Thus where only physical contact is required, a conductive material is used. On the other hand where pressure or insulating circuits or materials are necessary, a non-conductive material is used.

By the above described invention the pushbutton member can operate the dome switch through a pivoting or rocking action as well as a downward or linear force. Thus, the operator has freedom to operate switch by rocking in joystick fashion. Moreover, much greater tolerances are provided for actuation of the switches and the "egg crate" frame is eliminated.

Although the invention has been shown in a specific embodiment, it is obvious that other variations and modifications are possible and it is intended to include all such as fall within the spirit and scope of the appended claims.

What is claimed is:

1. A dome switch actuating apparatus comprising:

a support member having a plurality of slot openings therein;

a switch member having a dome shape mounted on said support member intermediate said openings, an elongated button actuating member positioned in overlying relation to said switch member, an elastomeric member positioned intermediate said actuating member and said switch member, said elastomeric member having an aperture formed therein, said elongated actuating member having a tip portion extending for a predetermined distance along an axis parallel to the longitudinal axis thereof coaxially received within the aperture towards said switch member, 2. Apparatus according to claim 1 wherein said hook portions extend inwardly at right angles to said leg members.

3. Apparatus according to claim 1 wherein said support member has a plurality of switch members and associated actuating members and a housing with openings therein to provide access to said actuating members.

* * * * *

UNITED STATES PATENT AND TRADEMARK OFFICE

CERTIFICATE OF CORRECTION

PATENT NO. : 4,181,826

DATED : January 1, 1980

INVENTOR(S) : Leonard Latasiewicz

It is certified that error appears in the above-identified patent and that said Letters Patent are hereby corrected as shown below:

Column 2, line 28, change "captivate" to --captivated--. Column 4, line 5, after "member,", insert --said elongated actuating member having a plurality of leg members extending along an axis which is parallel to the longitudinal axis thereof and is offset from the axis of said tip portion by a predetermined extent, each of said leg members being received by one of said slot openings and having a hook portion on the end thereof for engagement with said support member against the pressure biasing action of said elastomeric member whereby said switch member can be actuated by a pivot force on said elongated actuating member as well as by a linear force directed along the longitudinal axis thereof.--.

Signed and Sealed this

*Twenty-second* Day of *July 1980*

[SEAL]

*Attest:*

SIDNEY A. DIAMOND

*Attesting Officer*

*Commissioner of Patents and Trademarks*